US008490414B2

(12) United States Patent
Hon et al.

(10) Patent No.: US 8,490,414 B2
(45) Date of Patent: Jul. 23, 2013

(54) CRYOCOOLER WITH MOVING PISTON AND MOVING CYLINDER

(75) Inventors: Robert C. Hon, Playa del Rey, CA (US); Lowell A. Bellis, Long Beach, CA (US); Cyndi H. Yoneshige, Huntington Beach, CA (US); Carl S. Kirkconnell, Huntington Beach, CA (US); Michael C. Barr, Torrance, CA (US)

(73) Assignee: Raytheon Company, Waltham, MA (US)

( * ) Notice: Subject to any disclaimer, the term of this patent is extended or adjusted under 35 U.S.C. 154(b) by 1150 days.

(21) Appl. No.: 11/803,894

(22) Filed: May 16, 2007

(65) Prior Publication Data

US 2008/0282707 A1 Nov. 20, 2008

(51) Int. Cl.
*F28B 9/00* (2006.01)
*F01B 29/10* (2006.01)

(52) U.S. Cl.
USPC ..... 62/6; 60/517; 60/518; 60/520; 60/525

(58) Field of Classification Search
USPC ..... 62/6; 60/516, 517, 518, 520, 525
See application file for complete search history.

(56) References Cited

U.S. PATENT DOCUMENTS

| | | | | | |
|---|---|---|---|---|---|
| 3,515,034 | A | * | 6/1970 | Eklund | 92/152 |
| 3,657,877 | A | * | 4/1972 | Huffman | 60/531 |
| 3,802,211 | A | * | 4/1974 | Bamberg et al. | 62/6 |
| 3,986,360 | A | * | 10/1976 | Hagen et al. | 60/520 |
| 4,450,685 | A | * | 5/1984 | Corey | 60/520 |
| 4,511,805 | A | * | 4/1985 | Boy-Marcotte et al. | 290/2 |
| 4,697,113 | A | * | 9/1987 | Young | 310/15 |
| 5,022,229 | A | * | 6/1991 | Vitale | 62/6 |
| 5,088,289 | A | | 2/1992 | Mita et al. | |
| 5,317,874 | A | * | 6/1994 | Penswick et al. | 60/517 |
| 5,492,313 | A | * | 2/1996 | Pan et al. | 267/161 |
| 5,826,491 | A | * | 10/1998 | Steiger | 92/155 |
| 6,129,527 | A | * | 10/2000 | Donahoe et al. | 417/416 |

(Continued)

FOREIGN PATENT DOCUMENTS

| | | | |
|---|---|---|---|
| EP | 1 538 406 | A | 6/2005 |
| JP | 63 238368 | A | 10/1988 |
| JP | 2004 068662 | A | 3/2004 |
| SU | 1 651 054 | A1 | 5/1991 |

OTHER PUBLICATIONS

Database WPI Week 198835, Thomson Scientific, London, GB, AN 1988-248229, XP002499651 & SU 1 374 002 A, OMSK POLY, Feb. 15, 1988, the whole document.

*Primary Examiner* — Allen Flanigan
*Assistant Examiner* — Jason Thompson

(57) ABSTRACT

A thermal-cycle cryocooler, such as a Stirling-cycle cryocooler, has a single working volume that is utilized by both the compressor and the displacer. The compressor and the displacer have respective movable parts, one of which is surrounded by the other. One of the parts may be a piston, a portion of which moves within a central bore or opening in a cylinder that is the other movable part. The piston may be a component of the compressor and the cylinder may be a component of the displacer, or vice versa. The working volume is located in part in a bore of the cylinder, between the piston and a regenerator that is coupled to the cylinder. Movements of either the piston or the cylinder can directly (i.e. without the use of a gas transfer line or flow passage) cause compression or expansion of the working gas in the working volume.

23 Claims, 4 Drawing Sheets

U.S. PATENT DOCUMENTS 6,327,862 B1 * 12/2001 Hanes ..... 62/6
6,688,113 B1 * 2/2004 Kunimoto et al. ..... 62/6
6,782,700 B1 8/2004 Unger et al.
6,843,057 B2 * 1/2005 Yamamoto ..... 60/520
7,891,184 B2 * 2/2011 Gimsa ..... 60/517

* cited by examiner

CRYOCOOLER WITH MOVING PISTON AND MOVING CYLINDER

BACKGROUND OF THE INVENTION

1. Technical Field of the Invention

The invention is in the field of cryocoolers.

2. Description of the Related Art

Long-life Stirling-class cryocoolers generally contain two central subsystems: a compressor that converts electrical energy into pressure-volume (PV) power, and a Stirling displacer that actively controls the thermodynamic compression/expansion cycle. PV power produced by the compressor must be transmitted into the displacer working volume. This transmission induces various parasitic losses of usable PV power along a transfer line between compressor and expander modules. This in turn results in a loss of overall system efficiency, which has negative effects on the larger system in which the cryocooler is integrated.

From the foregoing it will be appreciated that improvements in cryocoolers are possible.

SUMMARY OF THE INVENTION

According to an aspect of the invention a single-module cryocooler has a single working volume within a housing.

According to another aspect of the invention a single-module cryocooler does not require a gas transfer tube between separate modules.

According to yet another aspect of the invention a compressor and a displacer of a cryocooler have respective moving parts, one of which moves inside the other.

According to still another aspect of the invention, a thermal-cycle cryocooler includes: a compressor; a displacer; and a sealed housing enclosing the compressor and the displacer. The compressor and the displacer both act on a single combined working volume within the sealed housing.

According to a further aspect of the invention, a thermal-cycle cryocooler includes: a compressor; and a displacer. One of the compressor or the displacer includes a first movable part that moves within a second movable part of the other of the compressor or the displacer.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

Figure 1:
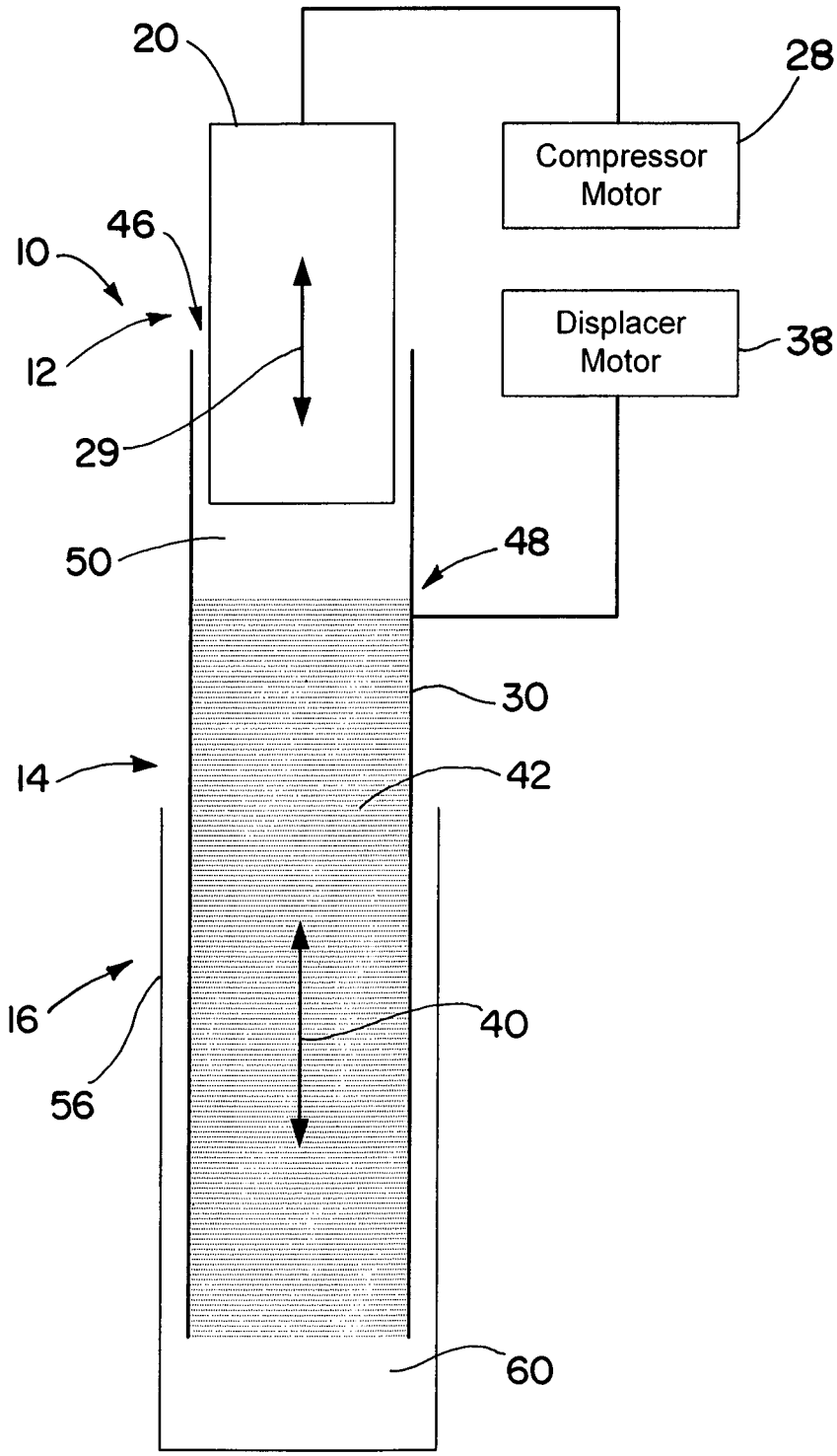
FIG. 1 is a schematic view of a cryocooler in accordance with an embodiment of the invention.
Figure 2:
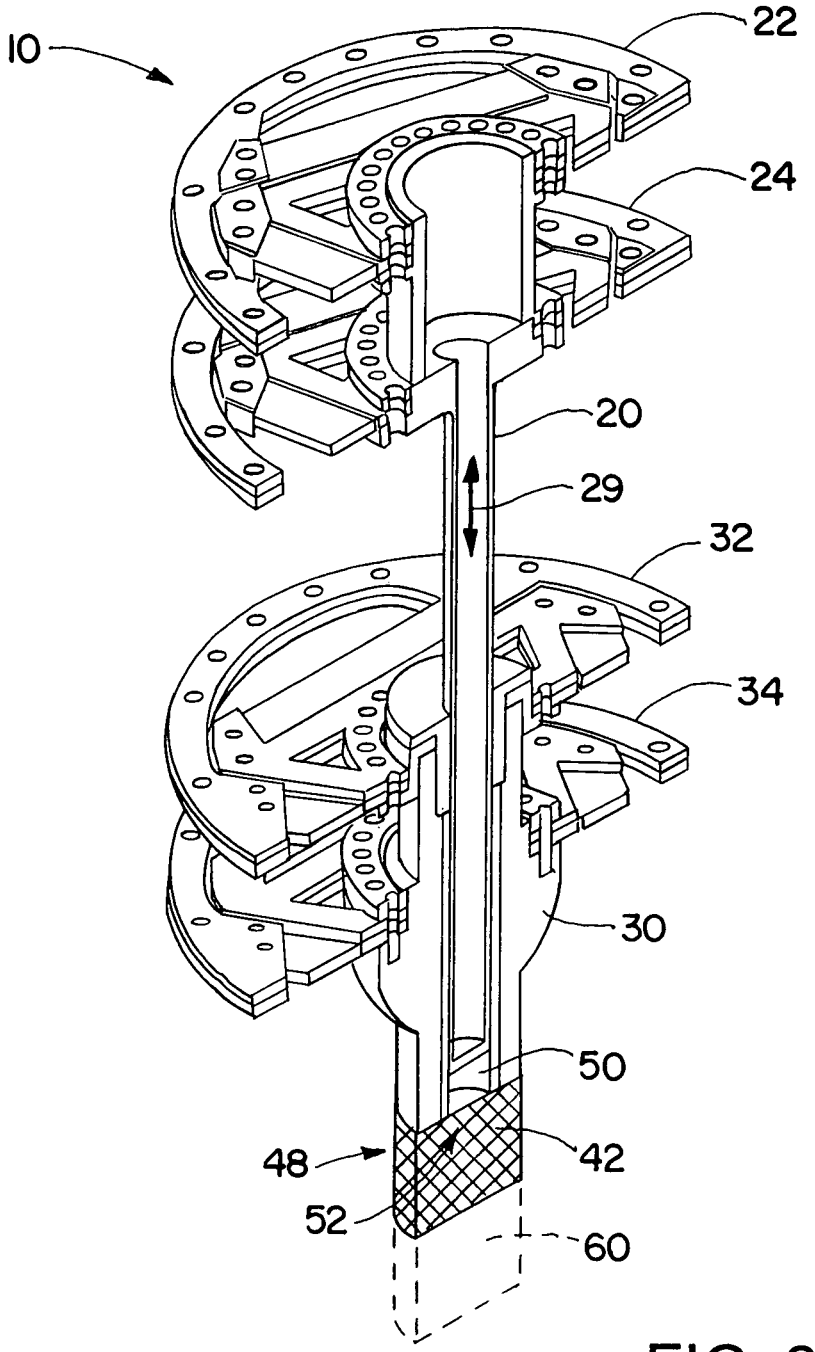
FIG. 2 is an oblique cutaway view of a movable portion of the cryocooler of FIG. 1.
Figure 3:
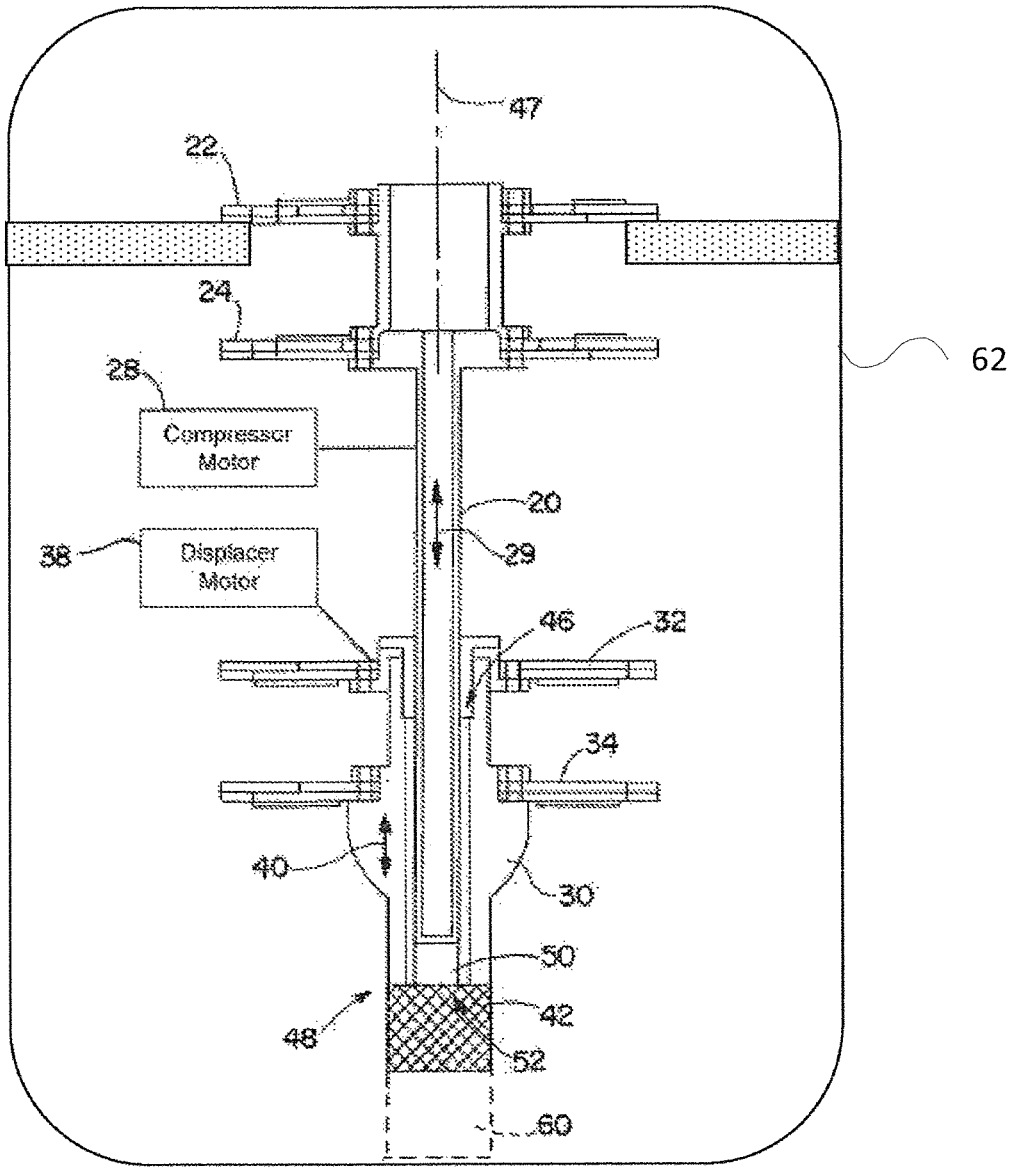
FIG. 3 is a sectional view showing portions of the cryocooler of FIG. 1.
Figure 4:
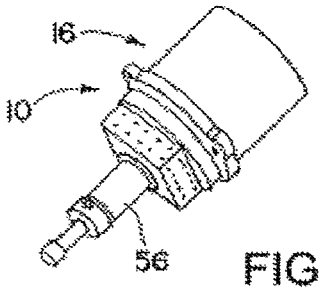
FIG. 4 is an oblique view of the cryocooler of FIG. 1, showing the sealed housing of the cryocooler.

A thermal-cycle cryocooler, such as a Stirling-cycle cryocooler, has a single working volume that is utilized by both the compressor and the displacer. The compressor and the displacer have respective movable parts, one of which is surrounded by the other. One of the parts may be a piston, a portion of which moves within a central bore or opening in a cylinder that is the other movable part. The piston may be a component of the compressor and the cylinder may be a component of the displacer, or vice versa. The working volume is located in part in a bore of the cylinder, between the piston and a regenerator that is coupled to the cylinder. Movement of either the piston or the cylinder can cause compression or expansion of the working gas in the working volume. A seal (clearance gap, sliding, etc.) is maintained between the piston and the cylinder to minimize leakage of the working gas in the working volume while still allowing for free movement of the piston and cylinder. The arrangement in which the compressor and the displacer utilize the same working volume allows many advantages for the cryocooler: straightforward placement of the compressor and the displacer in a single housing, reduced size and weight; elimination of parasitic losses from gas transfer; a reduction of seal losses due to elimination of several of the seals that are necessary in traditional two-module machines; and an establishment of all moving components on a single axis, therefore simplifying exported vibration mitigation.

Referring now to FIGS. 1-4, a cryocooler 10 includes a compressor 12 and a displacer 14 inside a hermetically sealed housing 16. The cryocooler 10 is a thermal cycle cryocooler, compressing and expanding a working gas, such as helium, in a thermodynamic cycle. An example of a suitable thermal cycle is a Stirling cycle, though many other types of thermal cycles are well known. A Stirling cycle is a thermal cycle that progresses through successive steps of isothermal compression, isochoric (constant volume) cooling, isothermal expansion, and isochoric heating. The cryocooler 10 thus may be a Stirling cycle cryocooler.

The compressor 12 includes a compressor piston 20 and a pair of compressor flexures 22 and 24. Movement of the compressor piston 20 and the compressor flexures 22 and 24 is controlled by a compressor motor 28. The compressor flexures 22 and 24 are fixed at their outer ends to a suitable stationary structure 62 within the housing 16. The piston 20 is coupled to inner openings of the compressor flexures 22 and 24. The compressor motor 28 is coupled to the compressor piston 20 and/or to the compressor flexures 22 and 24. The compressor motor 28 moves the compressor piston in a linear direction 29. The compressor motor 28 may be any of a wide variety of suitable motor types, such as suitable electric motors. Under the force of the compressor motor 28 the compressor piston 20 and the inner parts of the compressor flexures 22 and 24 move in a linear fashion.

The displacer 14 includes a displacer cylinder 30, a pair of displacer flexures 32 and 34, and a displacer motor 38. The outer parts of the flexures 32 and 34 are stationary relative to the housing 16. The inner parts of the displacer flexures 32 and 34 are attached to the Stirling displacer cylinder 30, and move in a linear fashion along with the displacer cylinder 30. The displacer is mechanically coupled to the displacer cylinder 30 and/or to the displacer flexures 32 and 34, in order to move the displacer cylinder 30 up and down in a linear direction 40. A regenerator 42 is coupled to the displacer cylinder 30, and moves with the displacer cylinder 30.

The compressor piston 20 and the displacer cylinder 30 have a suitable seal 46 between them. In the case of a clearance gap seal, the seal 46 is narrow enough to substantially prevent flow of the working gas through the gap between the compressor piston 20 and the displacer cylinder 30. The gap may be from a fraction of a mil to a few mils, where 1 mil=0.0254 mm.

The compressor piston 20 and the displacer cylinder 30 may be substantially axisymmetric. The compressor piston 20 and the displacer cylinder 30 may share a common axis 47, and may move in directions along the common axis 47. In addition, stationary parts are eliminated in the single-module cryocooler 10, relative to a dual-module prior cryocooler. In a prior dual-module cryocooler each moving part has a stationary partner or counterpart. With the moving parts 20 and 30 engaging each other, there is no need for stationary partners or counterparts.

The piston 20 and the displacer 30 define between them a unified compressor/displacer working volume 48. The compressor/displacer working volume 48 includes a hot working volume 48 that is in a bore 52 in the cylinder 30.

The housing 16 includes a housing portion 56 that defines a cold working volume 60 between the regenerator 42 and the housing portion 56. The unified compressor/displacer working volume 48 includes the hot working volume 50 and the cold working volume 60 are on opposite respective sides of the regenerator 42, as well as the volume of working gas within the regenerator.

The use of the same combined volume 48 for the cryocooler 10, without the inclusion of a transfer line or other flow passage, may make for a more thermodynamically efficient system, compared with prior dual-module cryocoolers that utilize separate warm working volumes for the compressor and displacer.

Figure 5:
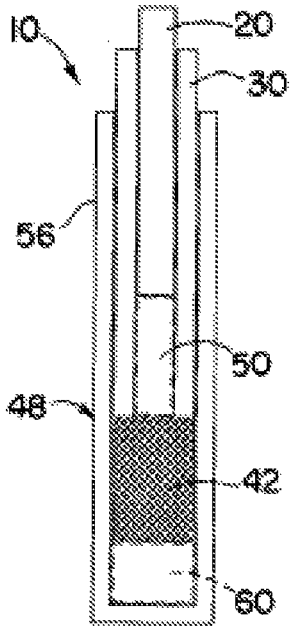
FIG. 5 shows the cryocooler of FIG. 1 at a first step of a single thermal cycle.

FIGS. 5-9 indicate the configuration of the movable parts of the cryocooler 10, the piston 20 and the cylinder 30, with respect to housing 16, at various points along the Stirling cycle. FIG. 5 shows an initial condition, with a relatively large hot working volume 50, and a relatively small cold working volume 60.

Figure 6:
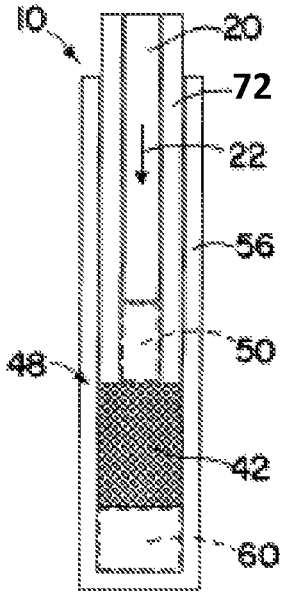
FIG. 6 shows the cryocooler of FIG. 1 at a second step of the thermal cycle.

FIG. 6 illustrates the isothermal compression of the hot volume 50, with the compressor piston 20 moving in a direction 72 to compress the hot working volume 50 between the piston 20 and the regenerator 42. During this step the displacer cylinder 30 remains substantially stationary.

Figure 7:
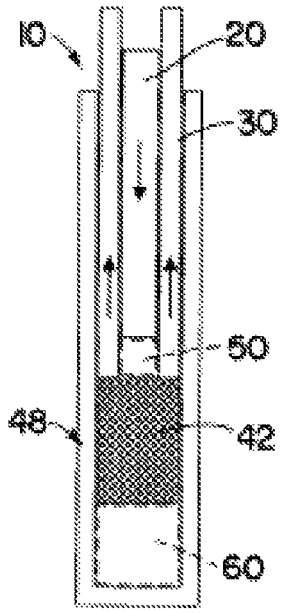
FIG. 7 shows the cryocooler of FIG. 1 at a third step of the thermal cycle.

Turning now to FIG. 7, isochoric cooling now occurs. The compressor piston 20 is moved in the same direction as in the previous step, to further reduce the hot working volume 50. At the same time, the displacer cylinder 30 is moved in an opposite direction, to thereby expand the cold working volume 60. The reduction of the hot working volume 50 is substantially similar to the increase in the cold working volume 60. Thus the combined volume of the cold working volume 60 and the hot working volume 50 remain substantially the same. This results in isochoric cooling of the working gas. In other words, working fluid is passed through the regenerator 42 from the hot working volume 50 to the cold working volume 60, without a change in the combined volume of the working volumes 50 and 60. Since the areas facing the hot working volume 50 and the cold working volume 60 may be different, the amounts and rates of movement of the compressor piston 20 and the displacer cylinder 30 may be different from one another.

Figure 8:
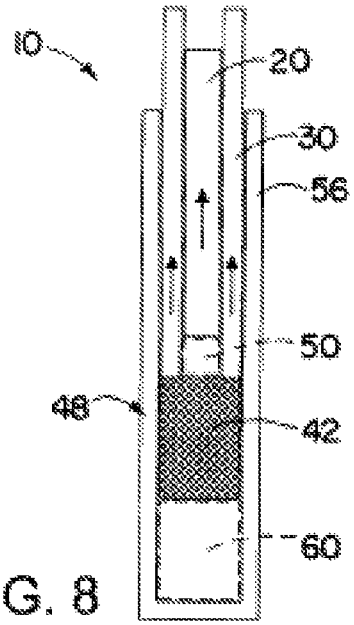
FIG. 8 shows the cryocooler of FIG. 1 at a fourth step of the thermal cycle.

FIG. 8 illustrates the next step in the Stirling cycle, an isothermal expansion. In this step the piston 20 and the displacer cylinder 30 are moved away from the housing portion 56 at the same volumetric rate. This increases the volume in the cold working volume 60, while maintaining as constant the hot working volume 50.

Figure 9:
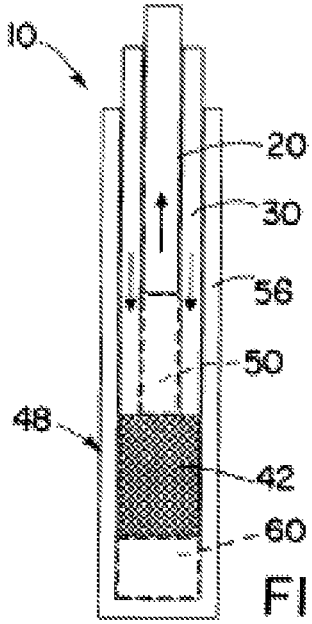
FIG. 9 shows the cryocooler of FIG. 1 at a fifth step of the thermal cycle.

Finally, as illustrated in FIG. 9, an isochoric heating is performed. The hot working volume 50 is increased, while the cold working volume 60 is decreased by a corresponding amount. This involves movement of the piston 20 away from the housing portion 56. Movement of the displacer cylinder 30 may also be involved, depending upon the differential area between the displacer cylinder 30 and the piston 20. The isochoric heating illustrated in FIG. 9 returns to the system to the initial condition shown in FIG. 5.

Work is put into the system and performance of the Stirling cycle illustrated in FIGS. 5-9. With insertion of this work, however, heat is removed from a cold region (in thermal communication with the cold volume 60) and heat is expelled to a hot region (in thermal communication with a hot volume 50). Thus work input in the Stirling cycle is used to remove heat from a cold region and expel heat to a hot region.

The cryocooler 10 offers many advantages when compared to traditional thermal cycle cryocoolers that have different modules for a compressor and a displacer. First of all, the cryocooler 10 avoids gas transfer losses between different modules. In a dual-module cryocooler a gas transfer line is used to couple together separate working volumes in the compressor and the displacer. The single-module cryocooler 10 has the single combined working volume 48, constituting the hot working volume 50, the cold working volume 60, and gas within the regenerator 42. The combined working volume 48 is within a single housing, the housing 16. This eliminates parasitic losses occurring with use of the gas transfer line in a dual-module cryocooler.

In addition, the cryocooler 10 reduces seal losses relative to prior dual-module cryocoolers. The cryocooler 10 requires only two seals, the seal 46 and the seal between the housing portion 56 and the displacer cylinder 30. Dual-module cryocoolers require at least three seals. This reduction in the number of required seals reduces the overall loss of efficiency associated with leakage through system seals. As a result, the overall efficiency of the cryocooler 10 is improved.

A further advantage of the single-module cryocooler is the reduction of overall mass and volume of the cryocooler system. Only one housing, the housing 16, is required for the cryocooler 10. This reduces the mass of the cryocooler 10, relative to dual-module cryocooler systems. Further, the cryocooler 10 may be made more compact than prior dual-module cryocooler systems. The reduction in volume may provide a significant advantage since volume may be at a premium in systems utilizing cryocoolers, for instance in space-based systems.

Another advantage is the consolidation of the vibration forces (associated with the movements of the internal cryocooler components) along a single axis, therefore reducing the dynamic complexity of the device. Many cryocooler applications are extremely vibration-sensitive, and cryocoolers, containing several internally-oscillating elements, are a chief source of vibration. Active and passive vibration control methods are often implemented in an effort to precisely balance the forces associated with the internal moving elements, thereby reducing the vibration output. Traditional two-module cryocoolers generate significant vibration forces in several axes, for instance the drive axes of the two modules; these forces must be cancelled in each of the axes in order to reduce both forces and moments. This type of cancellation necessitates cancellation mechanisms in both of the axes. The cryocooler 10 places all of the vibration forces on a single axis, simplifying the vibration cancellation mechanisms as well as the dynamics of the cancellation itself.

It will be appreciated that other cryocooler configurations are possible, including configurations that utilize a moving piston operating inside a moving cylinder. In addition, it will be appreciated that the concepts described herein are applicable to other types of cryocoolers that use both a displacer and a compressor, aside from single-stage Stirling cryocoolers. One example of such other cryocoolers are Raytheon RSP2 type cryocoolers, which are based on a Stirling design but also contain a pulse-tube portion. Multistage cryocoolers with a Stirling stage may utilized the features described herein, as may single-stage or multistage cryocoolers with both a displacer and a compressor, that use other types of thermal cycles.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A thermal-cycle cryocooler comprising:
a compressor comprising at least a first flexure;
a displacer;
a regenerator; and
a sealed housing enclosing the compressor and the displacer;
wherein the compressor and the displacer both act on a single combined working volume within the sealed housing;
wherein one of the compressor and the displacer includes a first movable part that moves within a second movable part of the other of the compressor and the displacer, wherein the combined working fluid is excluded from an annular space between the moving parts;
wherein the first movable part includes a piston;
wherein the second movable part includes a cylinder;
wherein at least a piston head of the piston moves within the cylinder;
wherein the first flexure is fixed to a stationary structure within the sealed housing; and
wherein the regenerator is attached to the cylinder and moves with the cylinder.

2. The cryo cooler of claim 1, wherein the regenerator is attached to and moves with the displacer.

3. The cryocooler of claim 1, wherein a first part of the combined working volume is in a bore of the second movable part.

4. The cryocooler of claim 3, wherein a second part of the combined working volume is outside the bore of the second movable part;
and wherein when the piston head moves within the cylinder, a portion of the combined working volume moves between the first part and second part of the combined working volume through the regenerator.

5. The cryocooler of claim 4, wherein:
the first part of the combined working volume includes a hot working volume; and
the second part of the combined working volume includes a cold working volume.

6. A thermal-cycle cryocooler comprising:
a compressor comprising at least a first flexure;
a displacer; and
a regenerator;
wherein the first flexure is fixed to a stationary structure within a housing of the thermal-cycle cryocooler;
wherein one of the compressor and the displacer includes a first movable part that moves within a second movable part of the other of the compressor and the displacer, wherein fluid is excluded from an annular space between the moving parts;
wherein the first movable part includes a piston head of a piston;
wherein the second movable part is a cylinder that partially or fully surrounds the piston head; and
wherein the regenerator is attached to the cylinder and moves with the cylinder.

7. The cryocooler of claim 6, wherein:
the movable parts both act on a single combined working volume with no required flow tubes or transfer lines;
a first part of the combined working volume is in a bore of the cylinder; and
a second part of the combined working volume is outside the bore.

8. The cryocooler of claim 7, wherein:
the first part of the combined working volume includes a hot working volume and a volume of working gas inside of the regenerator; and
the second part of the combined working volume includes a cold working volume.

9. The cryocooler of claim 6, wherein:
the compressor includes the first movable part; and
the displacer includes the second movable part.

10. The cryocooler of claim 6, wherein:
the displacer includes the first movable part; and
the compressor includes the second movable part.

11. The cryocooler of claim 6, further comprising a sealed housing that encloses both the compressor and the displacer.

12. The cryocooler of claim 6, wherein the movable parts both act on a single combined working volume.

13. The cryocooler of claim 6, wherein the movable parts have a gap seal between them in the annular space.

14. The cryocooler of claim 6, wherein:
the movable parts are both substantially axisymmetric; and
the movable parts share a single common axis.

15. The cryocooler of claim 6, further comprising a regenerator that is attached to and moves with the displacer.

16. The cryocooler of claim 1, wherein the compressor further comprises a second flexure fixed to the stationary structure.

17. The cryocooler of claim 16, wherein the first flexure is fixed to the stationary structure at an outer end of the first flexure, the second flexure is fixed to the stationary structure at an outer end of the second flexure, or both the first and second flexures are fixed to the stationary structure at outer ends of the first and second flexures.

18. The cryocooler of claim 16, wherein the displacer comprises at least a third flexure, an outer part of the third flexure being stationary relative to the housing.

19. The cryocooler of claim 18, wherein the displacer further comprises a fourth flexure, an outer part of the fourth flexure being stationary relative to the housing.

20. The cryocooler of claim 6, wherein the compressor further comprises a second flexure fixed to the stationary structure.

21. The cryocooler of claim 20, wherein the first flexure is fixed to the stationary structure at an outer end of the first flexure, the second flexure is fixed to the stationary structure at an outer end of the second flexure, or both the first and second flexures are fixed to the stationary structure at outer ends of the first and second flexures.

22. The cryocooler of claim 20, wherein the displacer comprises at least a third flexure, an outer part of the third flexure being stationary relative to the housing.

23. The cryocooler of claim 22, wherein the displacer further comprises a fourth flexure, an outer part of the fourth flexure being stationary relative to the housing.

* * * * *